United States Patent [19]

Link

[11] 4,407,594

[45] Oct. 4, 1983

[54] ERROR CORRECTING TYPEWRITER RIBBON SYSTEM

[75] Inventor: Manfred Link, Nuremberg, Fed. Rep. of Germany

[73] Assignee: Triumph-Adler A.G. fur Buround Informationstechnik, Nuremberg, Fed. Rep. of Germany

[21] Appl. No.: 267,929

[22] Filed: May 28, 1981

[30] Foreign Application Priority Data

Jun. 24, 1980 [DE] Fed. Rep. of Germany ..... 3023474

[51] Int. Cl.[3] ..... B41J 35/10; B41J 35/23

[52] U.S. Cl. ..... 400/212; 400/214; 400/697.1

[58] Field of Search ..... 400/697, 697.1, 212, 400/225, 227, 214, 227.2

[56] References Cited

U.S. PATENT DOCUMENTS

| | | | |
|---|---|---|---|
| 3,695,410 | 10/1972 | Kapp | 400/212 X |
| 3,747,734 | 7/1973 | Norman et al. | 400/697.1 |
| 3,997,046 | 12/1976 | Wolowitz | 400/697.1 |
| 4,247,210 | 1/1981 | Kacmarcik | 400/697.1 |

FOREIGN PATENT DOCUMENTS

| | | | |
|---|---|---|---|
| 1144446 | 10/1957 | France | 400/214 |

*Primary Examiner*—Edgar S. Burr
*Assistant Examiner*—Charles A. Pearson
*Attorney, Agent, or Firm*—Joseph R. Spalla

[57] ABSTRACT

An error correcting typewriter having separate elevating and feed mechanism for carbon and error correction ribbons includes a common cyclic motive source operable in response to type commands to drive a cam shaft which is axially shiftable by means of an electromagnet energized by a correction signal. Normally, the cam shaft is positioned in engagement with a carbon ribbon drive lever and out of engagement with an error correction ribbon drive lever. A shift of the cam shaft disengages it from the carbon ribbon drive lever and engages it with the error correction ribbon drive lever. The carbon ribbon drive lever simultaneously operates a carbon ribbon elevating mechanism and a feed mechanism. Energization of the electromagnet operates a lever which directly operates the correction ribbon feed mechanism and simultaneously shifts the cam shaft to engage it with the error correction ribbon drive lever which when driven is operative on the correction ribbon elevating mechanism.

1 Claim, 1 Drawing Figure

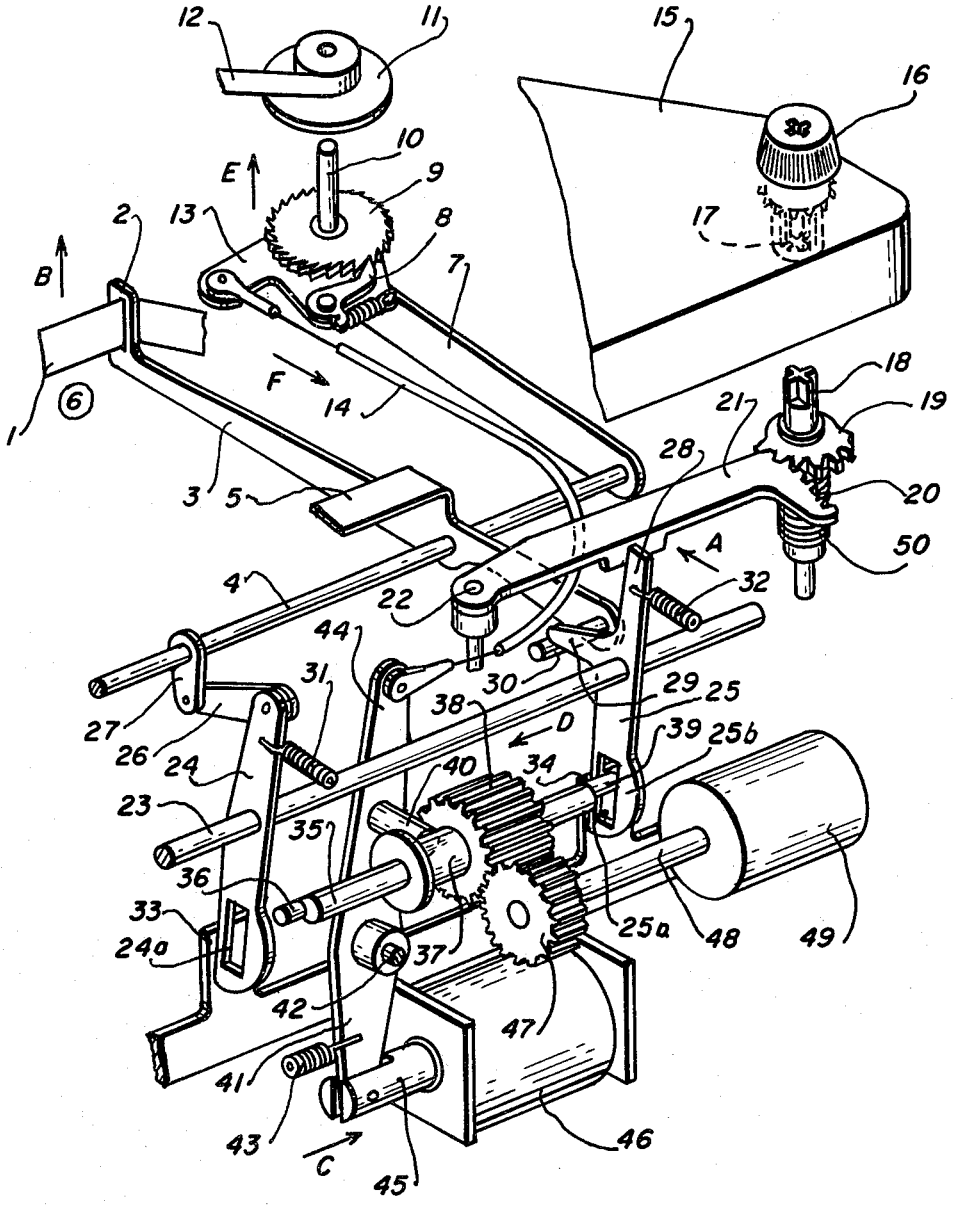
12
11
15
16
10
E
9
2
13
8
17
B
7
18
F
14
21
19
1
6
28
20
3
5
A
50
4
22
32
44
30
31
29
25
38
D
39
25b
27
26
24
40
34
23
35
36
33
25a
48
49
24a
37
42
47
41
43
46
C
45

ERROR CORRECTING TYPEWRITER RIBBON SYSTEM

This invention relates to an error correcting typewriter having separate carbon and correction ribbon elevating and feed mechanisms; more particularly it relates to an error correcting typewriter ribbon system having switching means normally connecting a cyclically operated motor source to the carbon ribbon elevating and feed mechanism and shiftable to connect the motor source to the correction ribbon elevating mechanism; and specifically it relates to a typewriter ribbon system in which the switching means includes a shift lever which is connected to operate the correction ribbon feed mechanism.

Modern typewriters are usually equipped with a correction ribbon in addition to a carbon ribbon. The correction ribbon, like the carbon ribbon, must be lifted to the typing level when needed and transported after the correction is made. Thus separate elevating and feed mechanisms are usually provided for each ribbon and are conditioned to be powered by a variety of expedients. From the aspect of their mechanical construction, these devices are very complicated and, hence, costly. In addition, rather involved electronic control systems are required.

It is an object of the invention to simplify the system as much as possible and to make do with relatively weak driving means.

Other objects, features and advantages of the present invention will become known to those skilled in the art from a reading of the following detailed description when taken in conjunction with the accompanying drawing wherein:

The single FIGURE is a perspective view showing elements of a typewriter ribbon system in accordance with one embodiment of the invention.

Referring now to the drawing there is shown in the single FIGURE a carbon ribbon 1 which is threaded through spaced guides 2 on the ends of support arms 3 which are rotatably mounted on a cross shaft 4 for elevating the carbon ribbon 1 to a typing line. A bridge 5 connects the support arms 3, only one of which is shown in the drawing. A type carrier, which may be in form of a type disc, a ball or the like, may be located in the area 6.

Fixedly mounted on shaft 4 is an arm 7 on which is supported a correction ribbon transport including a pawl 8 and a ratchet wheel 9 whose shaft 10 drivingly extends into the core of a take up spool 11 of a correction ribbon 12. The pawl 8 is rotatably mounted on a pivot lever 13 constituting part of the correction ribbon transport which is acted upon by a Bowden wire 14 to feed the correction ribbon 12 as will be described later.

The carbon ribbon 1 is accommodated, for example, on spools in a ribbon cassette 15, only a portion of which is shown. For reasons of clarity the position of the cassette 15 relative to the run of the carbon ribbon extending between spaced guides 2 externally of the cassette 15, as shown, does not conform to its actual position in the typewriter. The cassette 15 rotatably supports a take up mechanism including an external hand wheel 16 to take up the carbon ribbon 1. It also includes, projecting downwardly from the underside of the cassette 15, a shaped turning pin 17 which is adapted to be engaged with a complimentary shaped drive shaft 18 when the cassette 15 is mounted in the machine. The drive shaft 18 is fixed to a gear segment 19 which meshes with the teeth 20 of a segment lever 21 mounted so as to pivot about a frame supported pin 22.

Rotatably mounted on a frame supported cross shaft 23, are two levers 24 and 25. Lever 24 is connected to rotate the cross shaft 4 by means of a link 26 and an arm 27 when the lever 24 is pivoted about shaft 23 thereby, via arm 7, to elevate the correction ribbon transport assembly.

The lower ends of both levers 24 and 25 are provided with slots **24*a* and 25*a*, respectively. Both levers 24 and 25 are normally urged by springs 31 and 32, respectively, to urge their lower ends against frame supported stops 33 and 34**, respectively.

As shown in the single FIGURE, a shaft 35 suitably mounted for rotation and axial movement in frame supported brackets (not shown), is formed at its ends with crank pins 36 and 39 adapted to be received within slots **24*a* and 25*a* of levers 24 and 25, thereby to rock the associated lever when the shaft 35 is turned as will hereinafter appear. Intermediate its ends the shaft 35 carries a gear 38 and a formation defining an annular groove 37 which is engaged by a bolt 40 of a pivoted lever 41, mounted in the frame so as to pivot about a pivot pin 42. A spring 43 normally urges the lever 41 clockwise and shaft 35 to the right as shown with crank pin 39 in slot 25*a*. The Bowden wire 14 is hooked to the upper end 44 of the pivoting lever 41. Roughly in the area of the spring 43 the lower end of the pivoting lever 41 is connected to the armature 45 of an electromagnet 46. As shown the gear 38 meshes with another gear 47 fixed to the shaft 48 of motor 49**, preferably a stepping motor.

Normally the ribbon system is conditioned to elevate and feed the carbon ribbon 1. Thus, as may be seen in the FIGURE, the crank pin 39 normally extends into the slots **25*a* of the lever 25 while crank pin 36 is withdrawn from its associated slot 24*a*. As will be understood a typing command signal will energize the motor 49 to cause it to rotate 180°. Through gears 47 and 38, shaft 35, and with it the crank pin 39, turn 180° thereby to drive lever 25 which will pivot in the direction of arrow A against the force of spring 32. As a result a protrusion 29 extending from the upper end of the lever 25 will push against a pin 30 on the rear extension of the support arm 3 thereby to lift the support arms 3 about the shaft 4 in the direction of arrow B. This puts the carbon ribbon 1 into typing position. Simultaneously, the upper end 28 of the lever 25 will push against the segment lever 21 so that its teeth 20 and the gear segment 19 rotate the cassette drive 18. This rotary motion is transmitted to the transmitted device of the carbon ribbon 1 in the ribbon cassette 15. Accordingly, the carbon ribbon 1** is fed at the same time it is lifted.

After the character has been typed, the motor 49 will again be energized to turn another 180°. This causes the shaft 35 including its elements and thus the driven lever 25 to resume their basic position thus restoring also the support arms 3 and the segment lever 21 to their rest positions. While the return motion of the segment lever 21 is transmitted to the gear segment 19, it is not transmitted to the transport device for the carbon ribbon 1 in the cassette 15 in that they are connected through a one way spring clutch 50. The above described process is repeated in response to each typing command.

As hereinbefore noted, when lifting and transporting the carbon ribbon 1 in the manner just described the crank pin 36 of the shaft 35 is disengaged from the slot 24*a* of the follower lever 24. To effect a correction sequence, an error signal is applied to energize electromagnet 46 so that its armature 45 is pulled in the direction of arrow C. This causes the pivoting lever 41 to pivot counterclockwise against the force of spring 43 and the bolt 40 thereon acting in annular groove 37, to move the shaft 35 to the left in the direction of arrow D. In so doing, the crank pin 39 is withdrawn from the slot 25*a* of the carbon ribbon lever 25, whereas the crank 36 enters into the slot 24*a* of the correction ribbon lever 24. The shifting motion of the shaft 35 also causes the gear 38 to shift relative to the other gear 47. However, both gears remain in mesh because the gear 38 is of appropriately wide design.

Next, the command to type out the incorrect character energizes motor 49 to rotate 180° and thus crank 36 pin, with the result that lever 24 is driven about its pivot against the force of spring 31. This motion is transmitted via link 26 and arm 27, to the shaft 4 whose rotation elevates pivoting arm 7 and the correction ribbon transport mechanism supported thereby in the direction of arrow E positioning the error correction ribbon 12 opposite the typing line. As the support arms 3 for the carbon ribbon 1 are rotatably mounted on the shaft 4, they are unaffected by the rotation of shaft 4 and the carbon ribbon 1 is not elevated.

The pivoting motion of the pivot lever 41 also pulls on the Bowden wire 14 in the direction of arrow F thereby to rotate pivoting lever 13 with the result that pawl 8, rotates the ratchet wheel 9 and, hence, the take up spool 11 for the correction ribbon 12. The elevation and feeding of the correction ribbon 12 is effected prior to typing out the character to be corrected, in a manner similar to that for the carbon ribbon 1.

After a correction is made as by typing out the incorrect character, the motor 45 is again energized to rotate 180° thereby to return lever 24, the pivoting lever 13, and the transport pawl 8 as well as arm 7 to their starting or rest positions.

The electromagnet 46 need not be energized to maintain the shaft 35 shifted over the 360° cycle of a correction sequence in that after the shaft 35 is rotated 180°, its end 39 is positioned opposite a surface 25*b* of lever 25 and is blocked from shifting back under the urge of spring 43. More particularly if the electromagnet 46 is deenergized after the first 180° rotation of shaft 35 the spring 43 of the pivoting lever 41 will urge the shaft in the direction opposite of arrow D. However, since the shaft 35 has made its first 180° rotary motion, the crank pin 39, which was withdrawn from the slot 25*a* of the follower lever 25, is positioned opposite and therefore urged against contact surface 25*b* of the lever 25. This blocks shifting movement to the right under the indirect action of the spring 43 and thus obviates additional locking members. Accordingly, the electromagnet 46 can be deenergized after one pulse thus preventing undue heating thereof. During the second 180° rotation of the correction print cycle of the shaft 35 the crank pin 39 is again positioned opposite and can thus enter the slot 25*a* of the lever 25. During this motion of the shaft 35 in the opposite direction of arrow D the crank pin 36 simultaneously slides out of the slot 24*a*.

As is evident from the drawing and from the above, one motor 49 and one magnet 46 are sufficient to lift and transport both ribbons 1 and 12.

The invention claimed is:

1. An error correcting typewriter comprising
carbon ribbon elevating mechanism,
carbon ribbon feed mechanism,
error correction ribbon elevating mechanism,
error correction ribbon feed mechanism,
first pivotally mounted lever means for simultaneously driving said carbon ribbon elevating and feed mechanisms,
second pivotally mounted lever means for driving said error correction ribbon elevating mechanism,
a motor cyclically responsive to a typing command,
an axially shiftable cam shaft coupled to said motor and normally coupled to drive said first pivotally mounted lever,
an electromagnet energizable in response to an error signal,
third pivotally mounted lever means coupled to said cam shaft operable in response to energization of said electromagnet for shifting said cam shaft to decouple said cam shaft from said first pivotally mounted lever and to couple it with said second pivotally mounted lever for driving said error correction elevating mechanism in response to a typing command, and
a drive connection between said third lever means to said error correction ribbon feed mechanism for driving said error correction feed mechanism.

* * * * *